United States Patent [19]

Rieger

[11] 4,170,857

[45] Oct. 16, 1979

[54] FACADE CONSTRUCTION

[75] Inventor: Walter Rieger, Gmunden, Austria

[73] Assignee: Bauhütte Leitl-Werke Rieger-Anlagentechnik GmbH, Linz, Austria

[21] Appl. No.: 826,255

[22] Filed: Aug. 19, 1977

[30] Foreign Application Priority Data

Aug. 20, 1976 [AT] Austria ..... 6182/76

[51] Int. Cl.[2] ..... E04D 1/00

[52] U.S. Cl. ..... 52/513; 52/582

[58] Field of Search ..... 52/235, 510, 513, 506, 52/386, 387, 582, 511, 586, 496, 362, 363

[56] References Cited

U.S. PATENT DOCUMENTS

| | | | |
|---|---|---|---|
| 2,348,314 | 5/1944 | Spalding | 52/582 X |
| 2,899,821 | 8/1959 | Nycander | 52/302 |
| 3,234,702 | 2/1966 | Zibell | 52/506 X |
| 3,685,228 | 8/1972 | Pauley | 52/235 X |
| 3,950,906 | 4/1976 | Mollinger | 52/235 |

FOREIGN PATENT DOCUMENTS

| | | | |
|---|---|---|---|
| 1277541 | 9/1968 | Fed. Rep. of Germany | 52/235 |
| 2355314 | 5/1974 | Fed. Rep. of Germany | 52/235 |

*Primary Examiner*—Carl D. Friedman

*Attorney, Agent, or Firm*—Burns, Doane, Swecker & Mathis

[57] ABSTRACT

A facade construction made of plate-like construction elements having ground edge faces at which the elements are joined with one another without mortar. The plate-like construction elements have interior cavities, the cavities of superimposed construction elements forming through-going air passages connected toward the outside at least in the top and bottom portions of the facade. The ground edge faces form horizontal bearing-surfaces and vertical abutting-surfaces relative to adjoining construction elements. Between these horizontal bearing-surfaces and/or vertical abutting-surfaces of adjoining construction elements locking elements or elements for connection with the means securing the facade to a wall are arranged.

7 Claims, 9 Drawing Figures

FACADE CONSTRUCTION

The invention relates to a facade construction made of plate-like, preferably ceramic construction elements arranged beside and above one another and held at a distance from a wall, suitably an insulating layer being inserted in the intermediate space between the construction elements and the wall.

Facade-revetments for carcase walls of buildings under construction are known, in which plate-like construction elements, such as plates of fibrous cement, are secured to support- or sub-constructions, respectively. Such support-constructions consist either of wood lath trestles secured to the carcase wall or they may be light metal constructions in which light metal section rails are secured to the carcase wall by means of dowels. The facade plates are secured to the wood lath trestles or to the light metal constructions, respectively, by means of screws or clamps, or they are hung in.

The plate-like construction elements forming the real facade are not self-supporting, but are supported by the sub-construction. Facade constructions of this kind are complicated and their setting-up requires much work, since each individual plate-like construction element must be fixedly connected with the sub-construction. The great number of dowels results in a number of weak points. Furthermore, it is difficult to obtain a smooth outer facade without grinding, whenever the carcase wall is uneven. The precise adaptation of the plate-like construction elements is a complicated and time-consuming job.

The known constructions, particularly those provided with an insulating layer between facade and wall, involve the difficulty that the exchange of humidity relative to the outer atmosphere is impaired. On the one hand, humidity that has penetrated into the intermediate space or into the insulating layer (in case of humid weather conditions) prevents the insulating layer from fulfilling its insulating function, on the other hand, the insulating layer is a socalled steam catch causing hypermoistening of the wall construction and consequently warping and the like.

The invention aims at avoiding the described disadvantages and difficulties and has as its object to create a facade construction which on the one hand considerably reduces the working time and material expenditure needed to secure the facade to the wall, by designing the facade construction to be self-supporting without stressing the connecting elements; and which on the other hand safeguards that the uptake of moisture by an insulating layer with the ensuing detrimental effects is avoided.

In accordance with the invention, this object is achieved in a construction of the above-described kind in that the construction elements, which have vertically aligned cavities, particularly channels, which, for purposes of airing, are in connection with the outside air, at least at the lower and upper end of the facade construction, are, with ground bearing- and abutting-surfaces, joined to one another without mortar, wherein locking and connecting elements with the holding construction, respectively, are provided between the bearing- and/or abutting-surfaces of adjoining construction elements.

In order to enable the desired circulation of air through the facade, a transverse slot may be left open in the construction, either near to the ground or to the gable attachment, or the cavities of the construction elements of the upper and lower row of the facade construction may be provided with connections and/or openings to the surface of the construction. Apart from making possible the circulation of air and thus the free carrying-off of moisture from inside the building, the facade's cavities, thus enabling the circulation of air, present the additional advantage of being heat- and sound-insulating thus considerably improving the total insulating effect.

The self-supporting property of the facade-construction according to the invention is achieved by grinding the bearing- and abutting-surfaces of the construction elements and by joining them without mortar, paying greatest possible attention to a high degree of grinding precision; the deviations from the prescribed standard measures should not amount to more than approximately 0.4 mm.

For connecting the facade construction to the wall, one embodiment of the invention provides that the construction elements have recesses at their abutting-surfaces, in which vertically arranged rods and ropes, respectively, are inserted, the rods or ropes being locked with at least one of the adjoining construction elements. These rods and ropes may reach from the lower up to the upper side of the construction.

Preferably the construction elements are provided at their bearing surfaces with grooves, which, in horizontal direction, complement each other to form a recess in which section rods are inserted, which themselves can be connected with the vertical rods and ropes, respectively.

Another embodiment provides for section rods in the form of clamps having resilient arms at their upper and lower end, which can be inserted into the vertical channels of the construction elements.

According to the invention it is also possible to work without vertical rods and ropes, respectively, for instance by providing the construction elements on their side facing the wall at the bearing-surfaces with a groove, preferably L-shaped, in which a correspondingly formed section rod is inserted that can be fixed to the wall.

Another way to do without vertical rods and ropes, respectively, consists in providing the construction elements on their side facing the wall at the bearing-surfaces with a recess, into which an element with resilient arms can be inserted, which element is fixable to the wall, the resilient arms reaching into the vertical channels of the construction elements. A particularly preferred embodiment of the facade construction of the invention, which embodiment safeguards an attractive outer appearance, consists in providing the edging area of the bearing- and abutting-surfaces in the direction of the construction elements' surfaces with recesses and/or grooves of low depth. In this way a geometrical division of the facade construction is achieved which corresponds approximately to the appearance of a clinker-wall, an effect which is created very easily without mortar.

In order to achieve ornamental effects, the surfaces of the construction elements may be equipped with surface profilings and advantageously with a glaze.

Designing construction elements with built-in recesses in the edging areas of the abutting- and bearing-surfaces has not only the advantage of an attractive outer appearance of the facade construction, but elements which are equipped with a glaze at their surface also involve the advantage that the edges of the surface's glazed areas are not exposed to damage in case the construction elements are transported or the facade construction is set up.

The invention shall now be described in greater detail with reference to the accompanying drawings, wherein FIG. 1 is a view of the facade construction, FIG. 2 a vertical section along line II—II, and FIG. 3 a horizontal section along line III—III of FIG. 1.

In FIGS. 4 and 5 an embodiment of the connection of the facade construction on a vertical rod on a crossing-point between four construction elements touching each other with their corners is shown, FIG. 5 giving a section along line V—V of FIG. 4.

Figure 8:
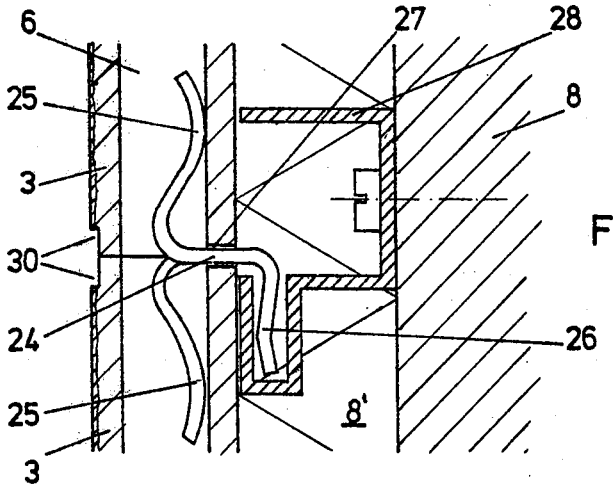
Figure 9:
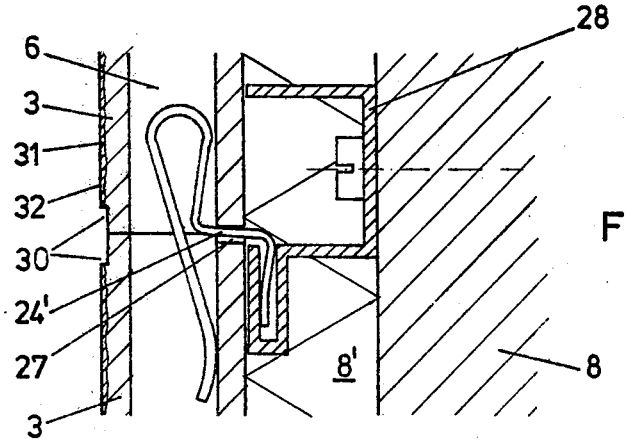

FIGS. 8 and 9, too, show such types of connections without the use of vertical rods and/or ropes in vertical sections.

The facade 1 is made up of construction elements 2 and 3 arranged beside and above one another. The construction elements have ground bearing- and abutting-surfaces 4 and 5 so that they can be joined to one another without using mortar. The construction elements 2 and 3 have continuous channels 6, which, in the example shown, have rectangular cross-section. The channels 6 of the construction elements arranged above one another form mutually aligned cavities extending from top to bottom, thus making possible the desired airing of the facade construction. Each lower and upper row of construction elements delimiting the facade is provided with openings 7 giving a connection to the outside air. Vertically tensioned ropes or rods 9 at a distance from the wall, which are fixed to the wall by fastening means 9', serve to fasten the facade construction to the wall 8. The construction elements have recesses 11 at their abutting-surfaces 5, which, whenever two construction elements are set beside one another, form an approximately rectangular chamber 12 which is open in direction to the wall 8. The distance between the rods and ropes, respectively, in each case corresponds to the distance between the recesses at the two ends of a construction element. At the upper, as well as at the lower bearing-surface of each construction element there are horizontal grooves 13 and 13' which complement each other to form a closed recess. Into these recesses section rods 14 are inserted which can be connected with the vertical rods or ropes 9. Between the facade construction and the wall 8 there is an insulating layer 8' made of heat-insulating material.

Figure 4:
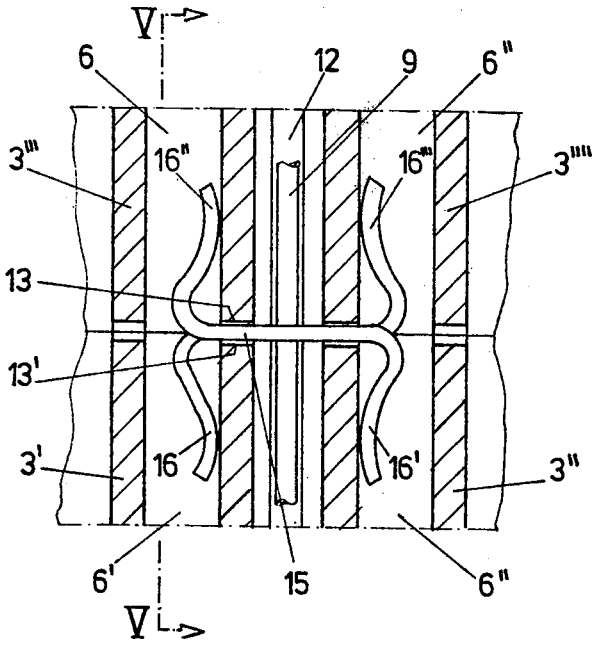
Figure 5:
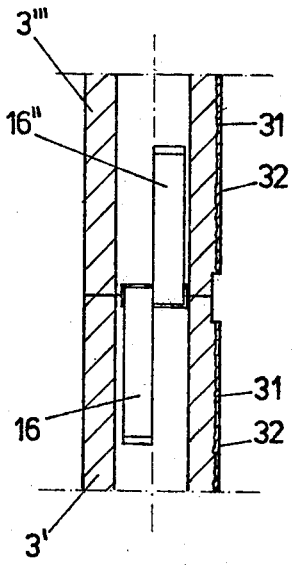

In the corner connection shown in FIGS. 4 and 5 a clamp 15 is inserted between the upper ends of two construction elements 3', 3'' and the lower ends of the superimposed row 3''', 3'''', and this clamp has in its center a recess surrounding the rod 9. The clamp is equipped with four resilient arms 16, 16', 16'', 16''', which reach into the mutually aligned channels 6, 6', 6'', 6''' of the upper and lower construction elements, respectively. The resilient arms on one side are formed by the clamp being slit and the slit parts being bent apart. In this embodiment, too, the construction elements are provided at their bearing-surfaces with horizontal grooves 13, 13', which receive the central part of the clamp without play so that the elements are secured against lateral shifting.

Figure 2:
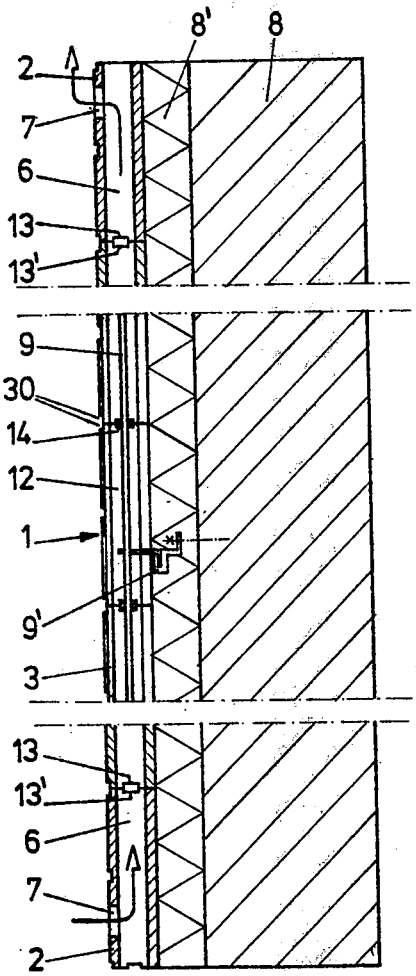
Figure 1:
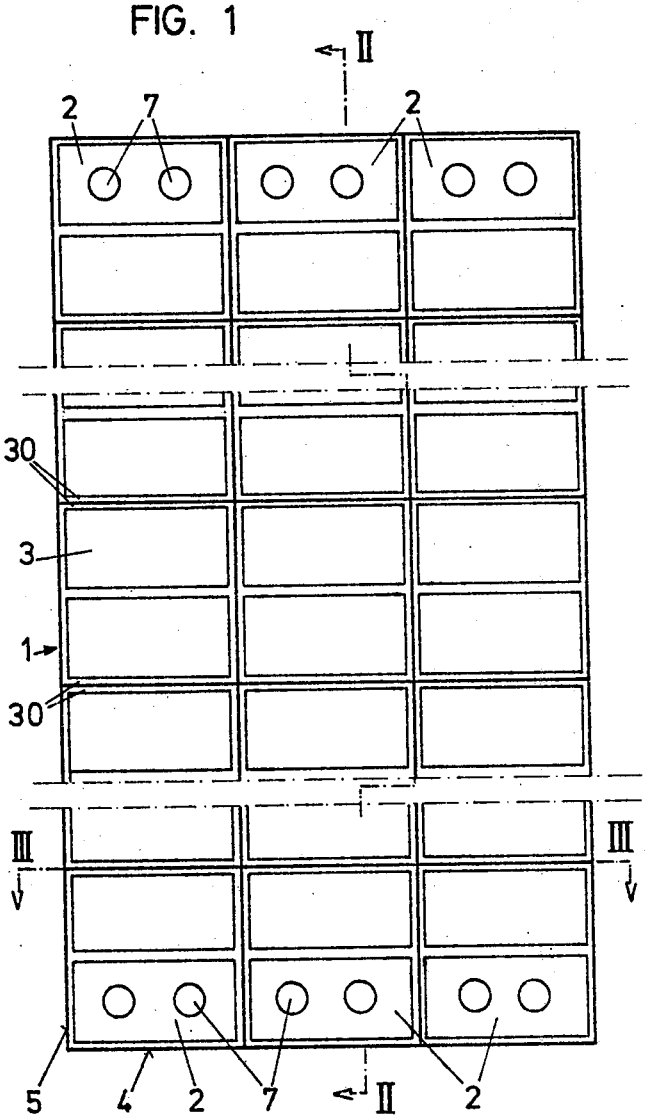
Figure 3:
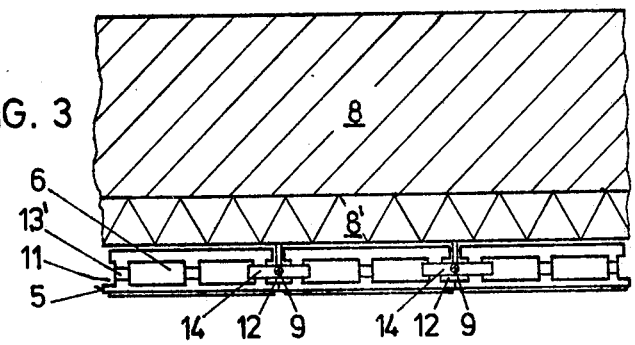
Figure 6:
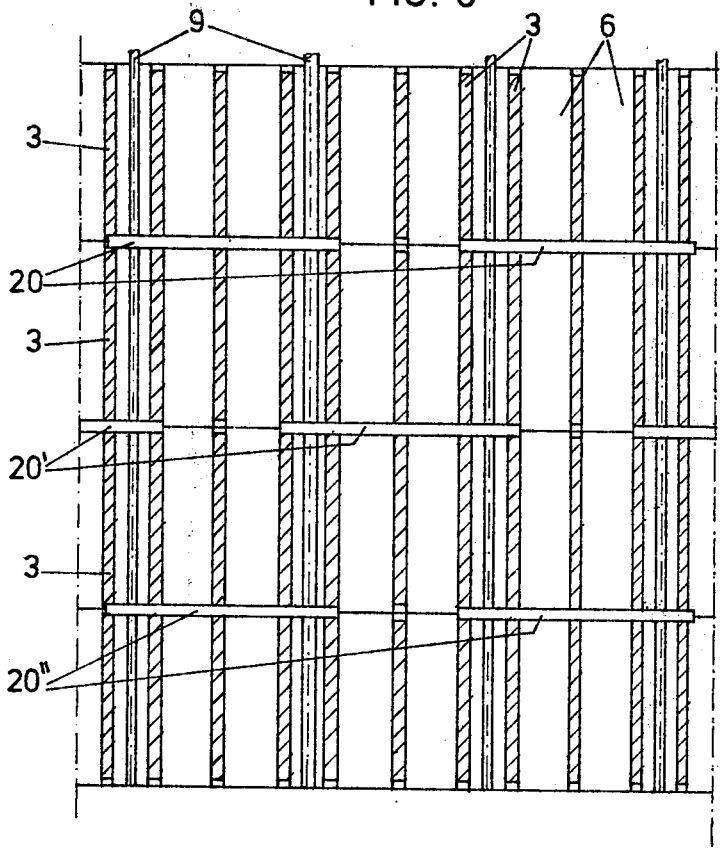
FIG. 6 shows a different type of fastening on a plurality of vertical rods arranged at a distance from one another in a section parallel to the facade.

FIG. 6 shows a type of fastening similar to FIGS. 2 and 3, except that the section rods, here denoted with 20, reach from one rod 9 to the neighboring rod 9 and connect them. In the superimposed horizontal rows of the construction elements the section rods are staggered and denoted with 20, 20', 20''.

Figure 7:
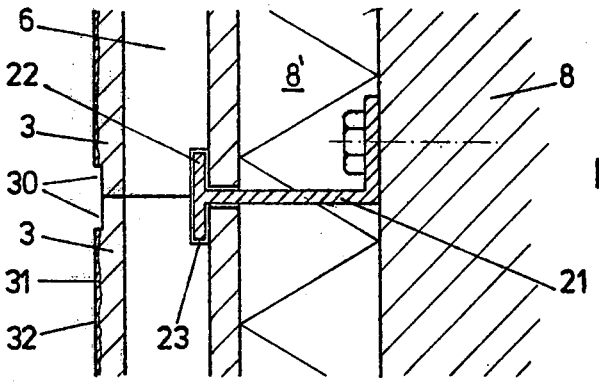
FIG. 7 shows a type of connection of the facade construction with the wall in which no vertical rods or ropes are used but a holding means which is directly fastened to the wall.

In the type of fastening according to FIGS. 7 to 9 no rods and ropes, respectively, are used, which are vertically tensioned at a distance from the wall and fastened thereto. In FIG. 7 the fastening is effected by means of a rail 21 which has a T-shaped head with a flange 22. This flange 22 reaches into a recess 23 which is formed whenever a lower and upper construction element are superposed. The rail 21 may reach over the length of several construction elements.

In the embodiment according to FIG. 8 a clamp 24 is used for fastening, which has resilient arms 25 and a supporting part 26. The supporting part 26 is led through the recess 27 on the back of the elements and supports itself against a holding rail 28 which itself is screwed to the wall 8. The resilient arms 25 are in a channel 6.

FIG. 9 shows an embodiment in which a similar type of claim 24' is used.

In all the embodiments described there are recesses and grooves, respectively, of low depth on the surface of the construction elements in the edging area of their bearing- and abutting-surfaces. Furthermore the surface of the construction elements is equipped with surface profilings 31 in the shape of flat impressions and elevations, as well as with a glaze 32, as can be seen in FIG. 5.

What I claim is:

1. In a facade construction including plate-like construction elements arranged beside and above one another in front of a wall and holding means for holding said plate-like construction elements at a distance from said wall, the improvement which is characterized in that said plate-like construction elements comprise cavities in vertical alignment with one another, which cavities, for airing purposes, are in connection with the outer air at least near the upper end and the lower end of the facade construction, and edge faces, said plate-like construction elements being joined to one another without mortar along their adjoining edge faces by connecting means provided between the adjoining edge faces of adjoining plate-like construction elements, wherein the edge faces further comprise vertical abutting-surfaces with recesses therein and wherein vertically arranged ropes are received in said recesses, the ropes being locked with at least one of the adjoining plate-like construction elements.

2. In a facade construction including plate-like construction elements arranged beside and above one another in front of a wall and holding means for holding said plate-like construction elements at a distance from said wall, the improvement which is characterized in that said plate-like construction elements comprise cavities in vertical alignment with one another, which cavities, for airing purposes, are in connection with the outer air at least near the upper end and the lower end of the facade construction, and edge faces, said plate-like construction elements being joined to one another without mortar along their adjoining edge faces by connecting means provided between adjoining edge faces of adjoining plate-like construction elements, wherein the edge faces further comprise horizontal bearing-surfaces with grooves therein, which grooves complement each other to form horizontally extending recesses, and wherein said holding means comprise vertically arranged elongate members, section rods being inserted into said horizontally extending recesses which section rods are connectable to said elongate members.

3. In a facade construction including plate-like construction elements arranged beside and above one another in front of a wall and holding means for holding said plate-like construction elements at a distance from said wall, the improvement which is characterized in that said plate-like construction elements comprise cavities in vertical alignment with one another, which cavities, for airing purposes, are in connection with the outer air at least near the upper end and the lower end of the facade construction, and edge faces, said plate-like construction elements being joined to one another without mortar along their adjoining edge faces by connecting means provided between adjoining edge faces of adjoining plate-like construction elements, wherein the edge faces further comprise vertical abutting-surfaces with recesses therein, vertically arranged elongate members being received in said recesses, and horizontal bearing-surfaces with grooves therein, which grooves complement each other to form horizontally extending recesses, section rods being inserted into said horizontally extending recesses, which section rods are connectable to said elongate members.

4. A facade construction as set forth in claim 3, wherein the section rods have the form of clamps wit resilient, upwardly and downwardly extending arms.

5. A facade construction as set forth in claim 4, wherein the resilient, upwardly and downwardly extending arms are arranged to reach into the cavities of said plate-like construction elements.

6. A facade construction including plate-like construction elements arranged beside and above one another in front of a wall and holding means for holding said plate-like construction elements at a distance from said wall, said plate-like construction elements having cavities, for airing purposes, which cavities are in connection with the outer air at least near the upper end and the lower end of the facade construction, and edge faces, said plate-like construction elements being joined to one another without mortar along their adjoining edge faces, and connecting means having a first portion secured to said wall and a holding portion extending into one of the cavities through a recess provided between adjoining edge faces of adjoining plate-like construction elements, the volume of said cavity being substantially larger than the volume of said holding portion located therewithin to provide for substantial ventilation, said holding portion comprising a clamp including resilient arm means, said resilient arm means including a first resilient arm connected with said first portion secured to said wall, and a second resilient arm engageable with an inner side of said cavity.

7. A facade construction as set forth in claim 6, wherein the portion of said resilient arm means disposed within the cavity has a bent configuration.

* * * * *